US011022132B2

(12) United States Patent
Post

(10) Patent No.: US 11,022,132 B2
(45) Date of Patent: Jun. 1, 2021

(54) DRAFT INDUCER BLOWER

(71) Applicant: Regal Beloit America, Inc., Beloit, WI (US)

(72) Inventor: Steven W. Post, Cassville, MO (US)

(73) Assignee: REGAL BELOIT AMERICA, INC., Beloit, WI (US)

( * ) Notice: Subject to any disclaimer, the term of this patent is extended or adjusted under 35 U.S.C. 154(b) by 653 days.

(21) Appl. No.: 15/817,981

(22) Filed: Nov. 20, 2017

(65) Prior Publication Data

US 2019/0154044 A1 May 23, 2019

(51) Int. Cl.

| | |
|---|---|
| ***F04D 27/00*** | (2006.01) |
| ***F04D 29/58*** | (2006.01) |
| ***F24H 1/20*** | (2006.01) |
| ***F23L 17/00*** | (2006.01) |
| ***F04D 29/46*** | (2006.01) |
| ***F04D 29/42*** | (2006.01) |
| ***F04D 29/60*** | (2006.01) |

(52) U.S. Cl.

CPC ..... *F04D 27/003* (2013.01); *F04D 29/4226* (2013.01); *F04D 29/464* (2013.01); *F04D 29/5806* (2013.01); *F04D 29/601* (2013.01); *F23L 17/005* (2013.01); *F24H 1/205* (2013.01)

(58) Field of Classification Search

CPC .... F23L 7/005; F04D 27/003; F04D 29/4226; F04D 29/5806; F04D 29/601; F24H 1/205

USPC ..... 126/307 R, 80

See application file for complete search history.

(56) References Cited

U.S. PATENT DOCUMENTS

| | | | | |
|---|---|---|---|---|
| 5,012,793 | A * | 5/1991 | Guzorek | F23J 13/025 126/293 |
| 6,511,290 | B1 | 1/2003 | Gatley, Jr. | |
| 6,602,058 | B1 * | 8/2003 | Stewart | F04D 25/082 417/366 |
| 6,827,560 | B2 | 12/2004 | Gatley, Jr. et al. | |
| 7,604,463 | B2 | 10/2009 | Gatley, Jr. et al. | |
| 8,079,834 | B2 | 12/2011 | Gatley, Jr. | |

OTHER PUBLICATIONS

Fasco Blower Product Catalog containing blowers first released for production at least as early as Dec. 12, 2016.
U.S. Appl. No. 14/194,099, filed Feb. 28, 2014.
U.S. Appl. No. 15/183,040, filed Jun. 15, 2016.
U.S. Appl. No. 15/349,674, filed Nov. 11, 2016.
U.S. Appl. No. 15/381,443, filed Dec. 16, 2016.

* cited by examiner

*Primary Examiner* — Vivek K Shirsat
(74) *Attorney, Agent, or Firm* — Thompson Coburn LLP

(57) ABSTRACT

A draft inducer blower assembly includes a blower having a fan, a dilution air intake passage, an exhaust gas intake passage, and a discharge passage. The blower is configured to operatively connect to a heater system in a manner to facilitate flow of combustion air into a combustion chamber and to draw dilution air into the blower and to mix the dilution air with the exhaust gases and to facilitate flow of the mixed air and exhaust gases through the vent. The dilution air intake passage is positionable in at least a low flow configuration and a high flow configuration. The dilution air intake passage is more restrictive of intake of dilution air in the low flow configuration than in the high flow configuration.

30 Claims, 12 Drawing Sheets

DRAFT INDUCER BLOWER

CROSS-REFERENCE TO RELATED APPLICATIONS

None.

STATEMENT REGARDING FEDERALLY SPONSORED RESEARCH OR DEVELOPMENT

Not Applicable.

APPENDIX

Not Applicable.

BACKGROUND

This disclosure relates generally to a draft inducer blower and, more particularly, to a draft inducer blower configured to meter the amount of dilution air the draft inducer blower intakes.

In a typical installation of a gas-fueled heater system, an appliance such as a hot water heater is coupled to a dilution blower assembly which is in turn coupled to a vent. The appliance includes a burner that burns a mixture of fuel (e.g., natural gas, propane, or the like) and combustion air. The dilution blower assembly is adapted to draw in dilution air and mix the dilution air with exhaust gases from the appliance prior to exhausting the mixture through a vent. The blower is typically either a single speed or a two-speed motor powered blower, and the blower is typically designed for use with a vent of a maximum length and a vent of a minimum length.

In the case of a single speed blower, the blower speed must be sufficiently high to exhaust the mixture of exhaust gases and dilution air when used with a vent of the maximum length. If the blower is used in a system having a vent of the minimum length, this blower speed causes the blower to overdraw the appliance exhaust gases and reduce the efficiency of the system (e.g., by drawing more combustion air into the burner and disrupting the air fuel mixture such that the burner runs lean).

A two speed blower can alleviate this problem, but requires additional components such as sensors to sense pressure which may be indicative of the length of the vent. Furthermore, because the two speed blower is capable of operating at only two speeds, the efficiency of the system is reduced at vent lengths not corresponding to the two speeds (e.g., a vent of an intermediate length between the minimum and maximum vent length) as the burner will run either rich or lean.

Additionally, different appliances may specify different exhaust gas draw rates for improving efficiency (e.g., to facilitate combustion and/or improve the amount of heat transferred to a heat exchanger from exhaust gases traveling through a flue). Therefore, a single speed blower may not be suited to use with different types of appliances and may result in reduced efficiency when used with certain appliances. A two speed blower can alleviate this problem but suffers from the same drawbacks previously mentioned.

SUMMARY

One aspect of the disclosure relates to a draft inducer blower assembly for use with a gas-fueled heater system having a combustion chamber and a vent. The blower assembly includes a blower having a fan, a dilution air intake passage, an exhaust gas intake passage, and a discharge passage. The dilution air intake passage is configured to be in fluid communication with dilution air. The exhaust gas intake passage is adapted to receive exhaust gases from the combustion chamber, and the discharge passage is configured to be in fluid communication with the vent. The blower is configured to operatively connect to the heater system. The blower is configured to facilitate flow of combustion air into the combustion chamber, draw dilution air into the blower, mix the dilution air with the exhaust gases, and facilitate flow of the mixed air and exhaust gases through the vent. The dilution air intake passage is positionable in at least a low flow configuration and a high flow configuration. The dilution air intake passage is more restrictive of intake of dilution air in the low flow configuration than in the high flow configuration.

Another aspect of the disclosure relates to a method including coupling a draft inducer blower assembly to a gas-fueled heater system. The gas-fueled heater system has a combustion chamber and a vent. The blower assembly includes a blower having a fan, a dilution air intake passage, an exhaust gas intake passage, and a discharge passage. The dilution air intake passage is in fluid communication with dilution air. The exhaust gas intake passage is adapted to receive exhaust gases from the combustion chamber, and the discharge passage is in fluid communication with the vent. The blower is operatively connected to the heater system. The blower is configured to facilitate flow of combustion air into the combustion chamber, draw dilution air into the blower, mix the dilution air with the exhaust gases, and facilitate flow of the mixed air and exhaust gases through the vent. The dilution air intake passage is capable of being in at least a low flow configuration and a high flow configuration. The dilution air intake passage is more restrictive of intake of dilution air in the low flow configuration than in the high flow configuration.

BRIEF DESCRIPTION OF THE DRAWINGS

The accompanying drawings, which are incorporated in and form a part of the specification, illustrate the embodiments of the present disclosure and together with the description, serve to explain the principles of the disclosure. In the drawings.

DETAILED DESCRIPTION

Figure 1:
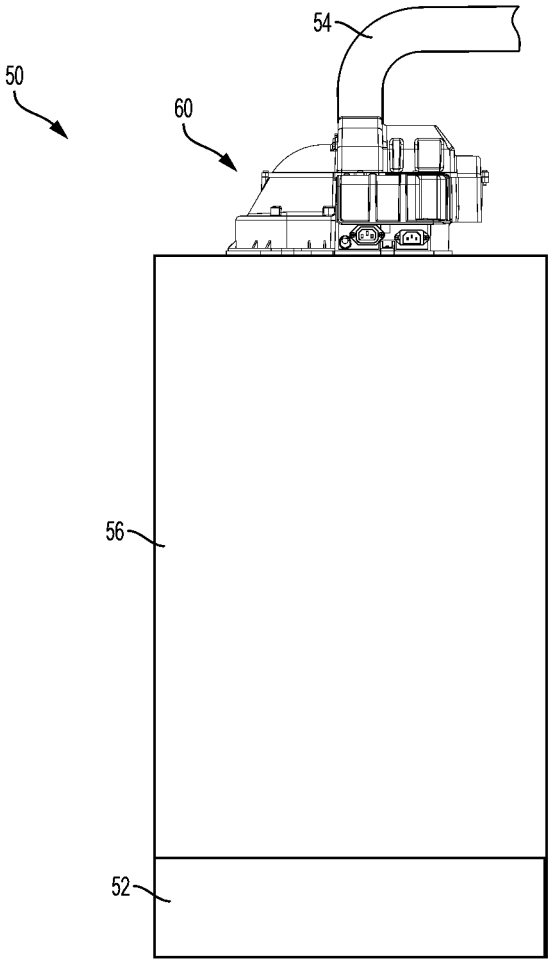
FIG. 1 is a schematic side view of a gas-fueled heater system.
Figure 2:
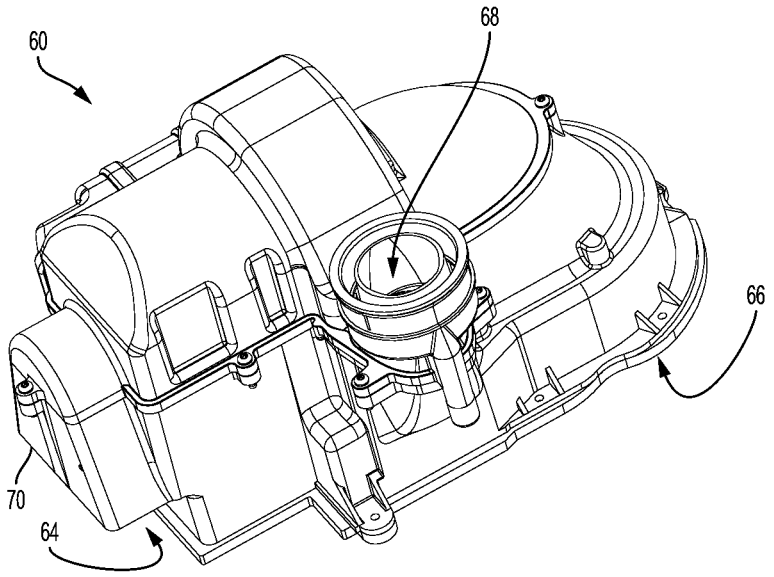
FIG. 2 is a perspective view of one embodiment of a blower assembly for use with the gas-fueled heater system shown in FIG. 1.
Figure 3:
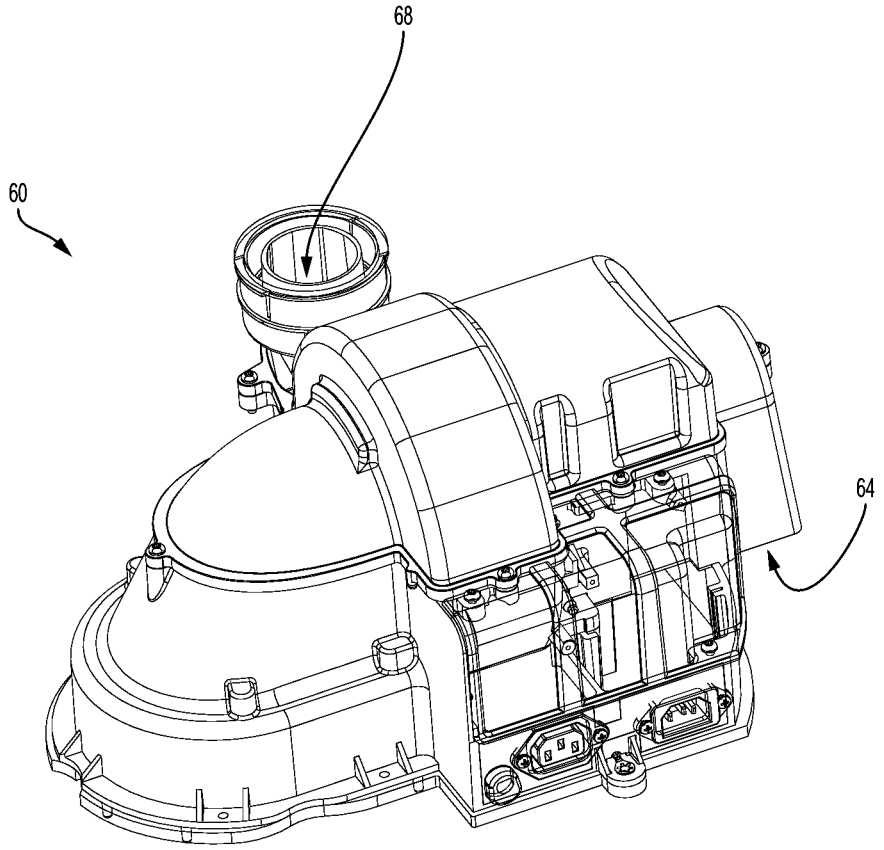
FIG. 3 is a further perspective view of the blower assembly shown in FIG. 2.
Figure 4:
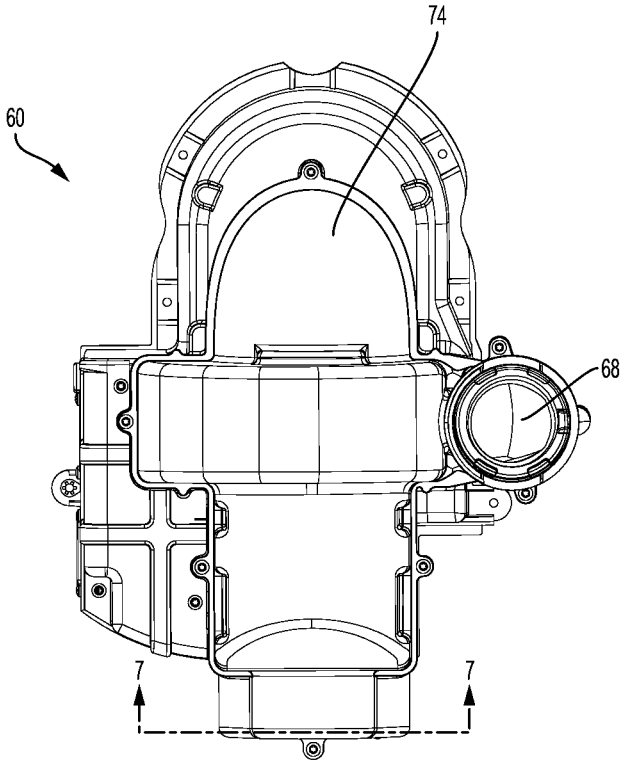
FIG. 4 is a top view of the blower assembly shown in FIG. 2.
Figure 5:
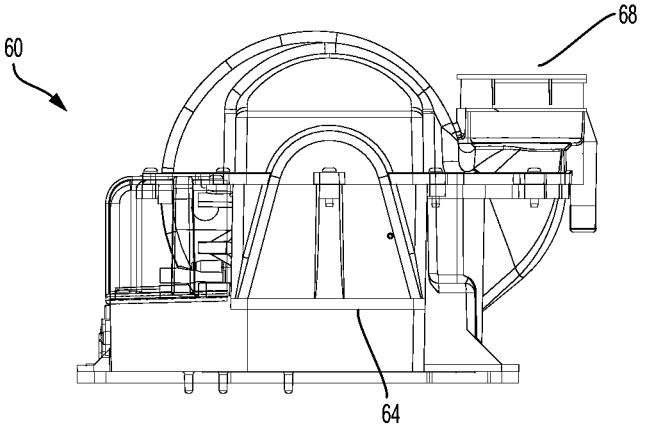
FIG. 5 is a side view of the blower assembly shown in FIG. 2.
Figure 6:
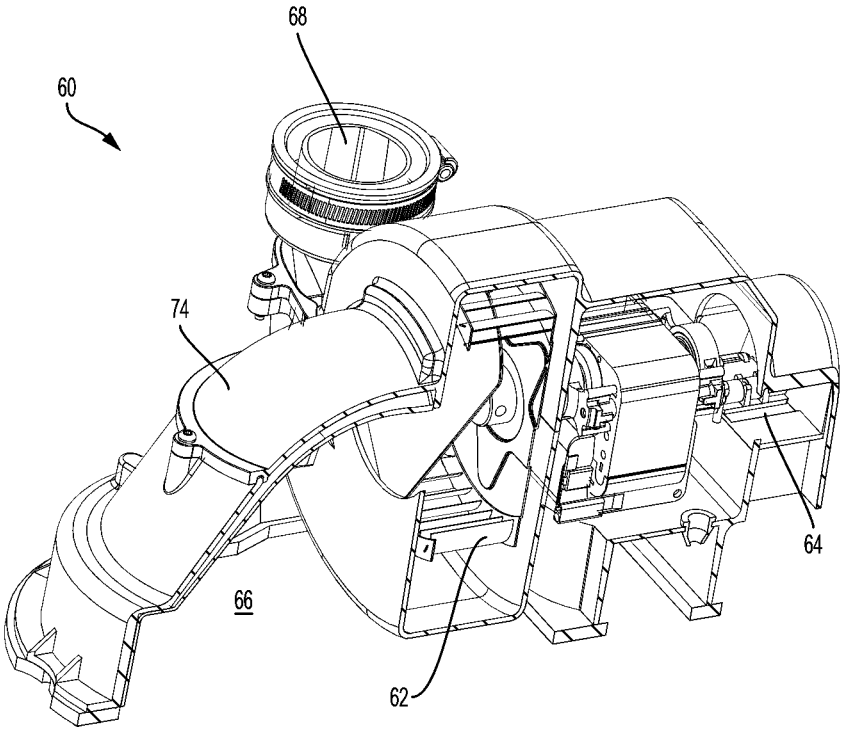
FIG. 6 is a perspective view of the blower assembly shown in FIGS. 2-4 with portions broken away to show details.

FIG. 1 depicts a gas-fueled heater system 50 (e.g., a hot water heater or a furnace) and a draft inducer blower assembly 60. The gas-fueled heater system 50 includes a combustion chamber 52 and a vent 54. The combustion chamber 52 includes a burner (not shown) that burns gas fuel and combustion air in the combustion chamber 52. The combustion reaction produces exhaust gases. The blower assembly draws the exhaust gases through an appliance 56 (e.g., through a flue) where heat is transferred from the exhaust gases. The blower assembly 60 is a draft inducing blower, drawing the exhaust gases from the flue and exhausting at least the exhaust gases through the vent 54. The blower assembly may also intake dilution air and mix the dilution air with the exhaust gases prior to discharging the mixture into the vent 54. The vent 54 may vent exhaust gases to an exterior of a structure. For example, and without limitation, the gas-fueled heater system 50 may comprise a water heater. The blower assembly 60 generates a draft drawing the exhaust gases into the blower assembly and dilution air into the blower assembly where the two mix. The mixture is exhausted from the blower assembly into the vent 54 and vented out of a building.

FIGS. 1 through 9 depict the blower assembly 60 according to one embodiment. The blower assembly 60 includes a fan 62, dilution air intake passage 64, an exhaust gas intake passage 66, and a discharge passage 68. The dilution air intake passage 64 is configured to be in fluid communication with dilution air. For example, and without limitation, the dilution air intake passage 64 is open at a first end 70 to ambient air about the blower assembly 60, the dilution air intake passage 64 is coupled to a pipe or other dilution air source, or the like. A second end 72 of the dilution air intake passage 64 is positioned nearer the fan 62 than the first end 70, and the second end 72 of the dilution air intake passage 64 places the dilution air intake passage in fluid communication with the fan 62. This allows the fan 62 to draw dilution air into the blower assembly 60 through the dilution air intake passage 64.

The exhaust gas intake passage 66 is adapted to receive exhaust gasses from the combustion chamber 52. For example, and without limitation, the exhaust gas intake passage 66 is at least a portion of a hood 74 positioned over a flue of the appliance 56. The exhaust gas intake passage 66 is in fluid communication with the fan 62. This allows the fan 62 to draw exhaust gases from the combustion chamber 52 into the blower assembly 60. The discharge passage 68 is configured to be in fluid communication with the vent 54.

The blower assembly 60 is configured such that the exhaust gases and the dilution air drawn into the blower assembly mix prior to passing through the fan 62. The mixture of exhaust gases and dilution air passes through the fan 62 and is discharged through the discharge passage 68 and then through the vent 54. The blower assembly 60 is configured to operatively connect to the heater system 50 in a manner to facilitate flow of combustion air into the combustion chamber 52 and to draw dilution air into the blower assembly 60 and to mix the dilution air with the exhaust gasses and to facilitate flow of the mixed air and exhaust gases through the vent 54. For example, and without limitation, the blower assembly 60 is coupled to the appliance 56 with the exhaust gas intake passage in fluid communication with a flue of the appliance 56. The fan 62 creates a vacuum which draws in exhaust gases and which also draws combustion air into the combustion chamber 52 thereby facilitating flow of combustion air into the combustion chamber. The fan 62 draws in dilution air which mixes with the exhaust gases. For example, and without limitation, the dilution air and the exhaust gases mix in a portion of the exhaust gas intake passage 66, a mixing chamber, or the like. The fan 62 then forces the mixture through the discharge passage 68 and into the vent 54.

Figure 9:
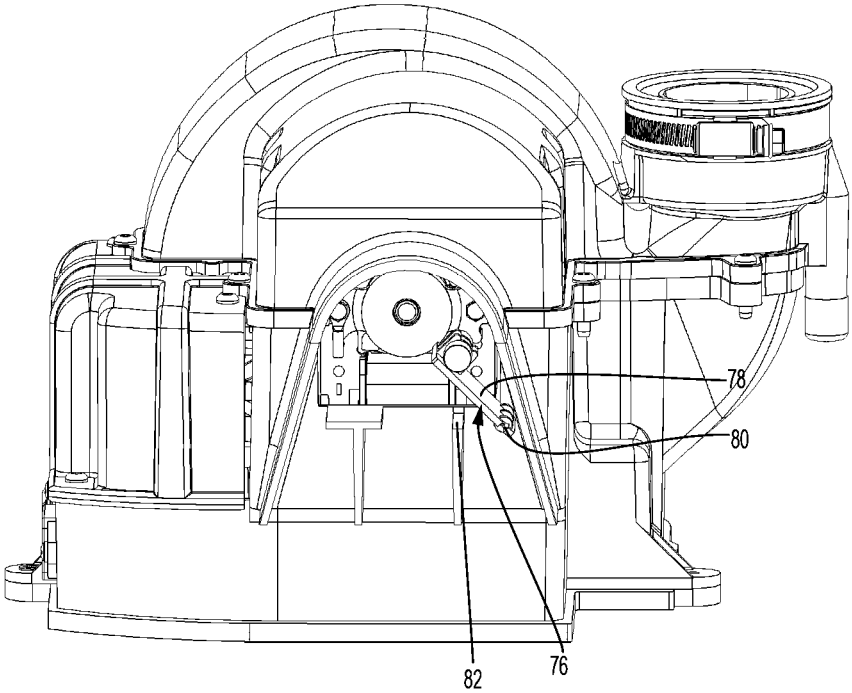
FIG. 9 is a cross sectional view taken along the plane of line 7-7 of FIG. 4, with a valve shown in a high flow position.

The dilution air intake passage is positionable in at least a low flow configuration (e.g., FIG. 7) and a high flow configuration (e.g., FIG. 9). With the dilution air intake passage 64 in the low flow configuration, the dilution air intake passage 64 is more restrictive of intake of dilution air than with the dilution air intake passage 64 in the high flow configuration. With the dilution air intake passage 64 in the high flow configuration, the dilution air intake passage 64 is less restrictive of intake of dilution air than with the dilution air intake passage 64 in the low flow configuration. For example, and without limitation, the dilution air intake passage 64 has a first effective cross-sectional area in the low flow configuration and has a second effective cross-sectional area in the high flow configuration. The second effective cross-sectional area is larger than the first effective cross-sectional area. The reduction in effective cross-sectional area restricts the dilution air intake passage 64 and causes the blower assembly 60 to draw more exhaust gases than with the dilatation air intake passage in the high flow configuration.

The blower assembly 60 is configured to draw dilution air and exhaust gases and mix the two at a first ratio of dilution air to exhaust gases when the dilution air intake passage 64 is in the high flow configuration. For example, and without limitation, the blower assembly 60 draws dilution air and exhaust gases and mixes the two in a mixing chamber to create a mixture at the first ratio. The blower assembly 60 is further configured to draw dilution air and exhaust gases and mix the two at a second ratio of dilution air to exhaust gases when the dilution air intake passage 64 is in the low flow configuration.

Because the dilution air intake passage 64 is movable between the low flow configuration (e.g., FIG. 7) and the high flow configuration (e.g., FIG. 9), the blower assembly can alter the ratio of dilution air to exhaust gases. This prevents the exhaust gases from being overdrawn (e.g., more dilution air is drawn and the dilution air intake passage 64 is in the high flow configuration) and causing the burner of the appliance 56 from running lean. This also prevents the exhaust gases from being underdrawn (e.g., less dilution air is drawn and the dilution air intake passage is in the low flow configuration) and causing the burner of the appliance 56 to run rich. The dilution air intake passage 64 is movable between the two configurations to compensate for various vent lengths while allowing the fan 62 to be driven by a single speed motor. The single speed motor is configured to operate in a single rotational speed range, the motor not operable at any rotational speeds outside the single rotational speed range except during transitory periods in which the motor transitions between on and off states. The dilution air intake passage 64 can also be tuned for operation with a variety of different appliances 56 specifying different exhaust gas draw rates. In other words, more dilution air is drawn by the blower assembly and the ration of dilution air to exhaust gases increases as the dilution air intake passage 64 moves from the low flow configuration toward the high flow configuration.

This configuration of the blower assembly 60 make the blower assembly 60 compatible with vents 54 of a predetermined minimum length, vents of a predetermined maximum length, and vents having a length between the minimum and maximum length. The blower assembly 60 is compatible with varying vents 54 because the dilution air intake passage 64 is configured to provide more dilution air when the blower assembly 60 is used with the vent 54 of the predetermined minimum length than when the blower assembly 60 is used with the vent 54 of the predetermined maximum length.

Figure 7:
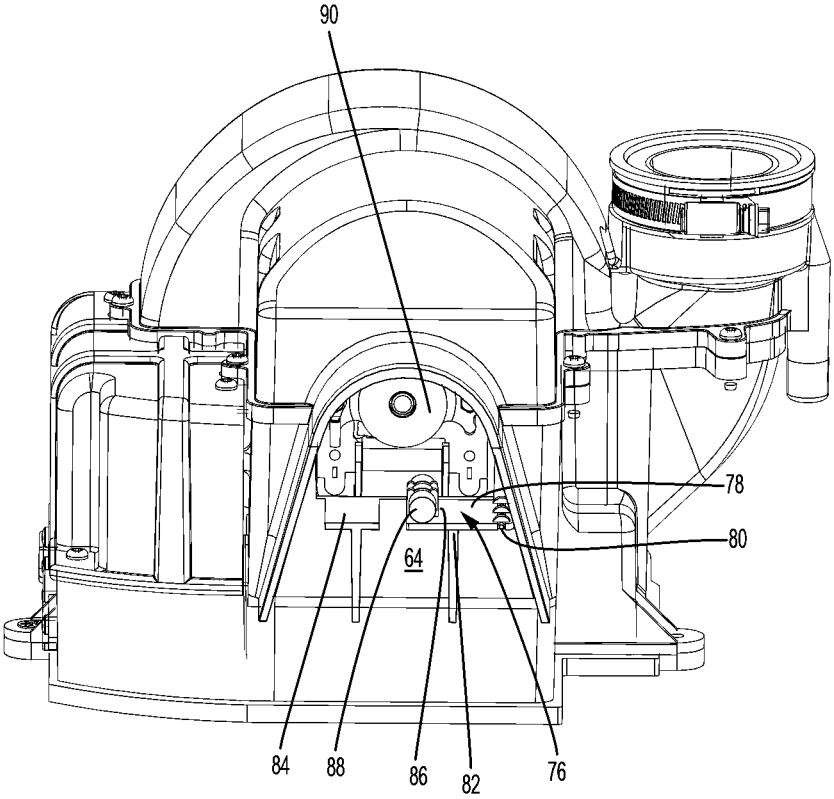
FIG. 7 is a cross sectional view taken along the plane of line 7-7 of FIG. 4, with the valve shown in a low flow position.

In one embodiment, the dilution air intake passage 64 comprises a valve 76 movable between a low flow position (e.g., as shown in FIG. 7) and a high flow position (e.g., as shown in FIG. 9). The dilution air intake passage 64 is in the high flow configuration when the valve 76 is in the high flow position, and the dilution air intake passage 64 is in the low flow configuration when the valve 76 is in the low flow position. The operation of the valve 76 allows the blower assembly 60 to vary the ratio of dilution air and exhaust gases that are drawn into the blower assembly 60 such that the exhaust gases or not over or underdrawn resulting in, respectively, the burner running lean or rich. This improves the efficiency of the gas-fueled heater system 50 even for installations using vents of different lengths. The valve 76 also allows for the use of single speed motor driving the fan 62. For example, in a minimum vent length installation overdrawing of the exhaust gases is prevented because the valve 76 is in the high flow position which causes the fan 62 to draw move dilution air and less exhaust gases than if the valve 76 were in the low flow position. Similarly, in a maximum vent length installation under-drawing of the exhaust gases is prevented because the valve 76 is in the low flow position which causes the fan 62 to draw more exhaust gases and less dilution air than if the valve 76 were in the high flow position.

The valve 76 is biased toward the low flow position. For example, and without limitation the valve 76 is biased toward the low flow position as a result of gravity operating on the valve 76. In alternative embodiments, the valve 76 is biased toward the low flow position by a spring, elastic, or the like. The valve 76 is adapted to move from the low flow position toward the high flow position as vacuum in the blower assembly downstream of the valve 76 increases beyond a predetermined threshold. For example, and without limitation, when the blower assembly 60 is used in an installation of a vent of maximum length, the vacuum downstream of the valve is less than in an installation of a vent of minimum length as a result of the resistance of the vent. In some embodiments, the valve 76 is actuated by the vacuum such that the valve 76 will remain in the low flow position until the vacuum force generated by the blower assembly 60 overcome the biasing force on the valve 76. As such, the vacuum force causes the valve 76 to automatically move from the low flow position toward the high flow position without the need for a sensor. In alternative embodiments, the valve 76 is actuated by a linear actuator, servo motor, servomechanism, solenoid, stepper motor, or the like (not shown) based on the vacuum downstream of the valve 76 sensed by a pressure sensor or the like (not shown).

Figure 8:
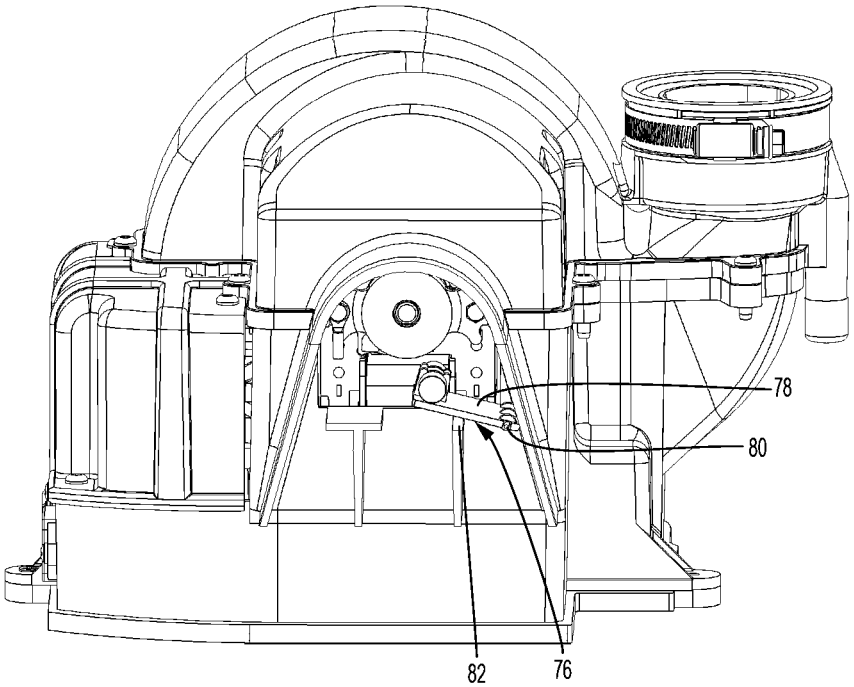
FIG. 8 is a cross sectional view taken along the plane of line 7-7 of FIG. 4, with a valve shown in a intermediate flow position.

The valve 76 is responsive to the downstream vacuum such that the valve 76 is variably positionable between the low flow position and the high flow position as a function of the vacuum. For example, and without limitation, in an installation in which the vent length is between the maximum and minimum length rated for the appliance 50, the vacuum force may cause the valve 76 to be positioned between the high and low flow positions (e.g., in an intermediate position as shown in FIG. 8). This position can result as the force of gravity and the force from the vacuum reach equilibrium. Advantageously, this allows the blower assembly 60 to vary the ratio of dilution air to exhaust gases for a variety of installations having different vent lengths and prevent over or under drawing of the exhaust gases in such installations.

In the depicted embodiment, the valve 76 includes a valve body 78 that coupled to a pin 80, hinge, or the like such that the valve body can pivot between the high flow and low flow positions. The valve body 78 seats with a valve seat 82 when in the low flow position. The valve body 78 is sized such that, even in the low position, the valve 76 does not obstruct the entirety of the dilution air intake passage 64. Therefore, at least some dilution air is drawn into the blower even when the valve 76 is in the low flow position. In some embodiments, the dilution air intake passage 64 includes a baffle 84 adapted and configured to define a minimum opening in the dilution air intake passage such that the valve 76 does not obstruct the entirety of the dilution air intake passage 64. In some embodiments, the baffle 84 is tuneable such that the blower assembly 60 is usable with a variety of appliances 56 each having different exhaust gas draw requirements. For example, the baffle 84 may be replaceable by another baffle 84 (e.g., an insert) that more greatly restricts the dilution air intake passage 64 (e.g., the baffle 84 has a greater effective cross-sectional area). This results in the blower assembly 60 drawing a greater amount of exhaust gases and less dilution air. A smaller baffle 84 may also be used to achieve the opposite result. In further embodiments, the baffle 84 may be formed with the housing of the blower assembly 60 and adjustable tooling may be used to form baffles 84 of varying sizes.

In some embodiments, the valve further includes a receptacle 86 configured to releasably receive at least a first mass 88 and a second mass (not shown). The first mass 88 is of a first weight and the second mass is of a second weight different from the first weight. The first weight and the second weight correspond to different gas-fueled heater systems 50 having different desirable dilution air flowrates and/or exhaust gas draw rates. The first and second masses enable a user to tune the blower assembly 60 to different gas-fueled heater systems 50 by selecting a mass that appropriately limits the dilution air draw through the dilution air intake 64. Using the masses, the user can set the predetermined threshold that the vacuum must exceed in order to move the valve 76 from the low flow position.

The blower assembly 60 may provide a further advantage in that a motor 90 coupled to the fan is positioned within the dilution air intake passage 64 or is otherwise in fluid communication with the dilution air. This allows the motor 90 to be cooled by dilution air before the dilution air mixes the combustion gases.

Figure 10:
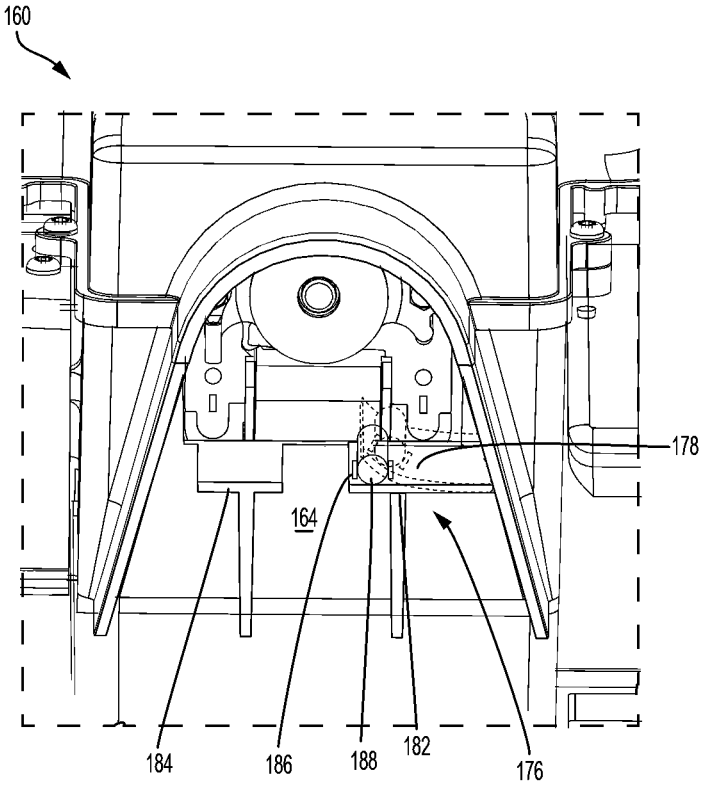
FIG. 10 is a side view of another embodiment of a blower assembly for use with the gas-fueled heater system shown in FIG. 1.

FIG. 10 depicts a portion of an alternative blower assembly 160. The blower assembly 160 is similar to the blower assembly 60, with like part numbers generally indicating similar parts in structure and/or function (e.g., air intake passage 64 and air intake passage 164 are the same). In this alternative embodiment, the valve 176 includes a flap 178 that is resiliently flexible from the low flow position to the high flow position. The valve 176 is shown in solid lines in the low flow position and shown in dashed lines in the high flow position. The resiliency of the flap 178 biases the flap 178 in the low flow position and allows the flap 178 to move from the low flow position toward the high flow position as vacuum in the blower downstream of the valve 176 increases beyond a predetermined threshold. The valve 176 is variably positionable between the low flow position and the high flow position as a function of the vacuum. As described with above, the valve 176 engages with a valve seat 182 when in the low flow position and restricts the dilution air intake passage 164 more in the low flow position than when in the high flow position. The blower assembly 160 may include a baffle 184, receptacle 186, mass 188, and other components similar to blower housing 60.

Figure 11:
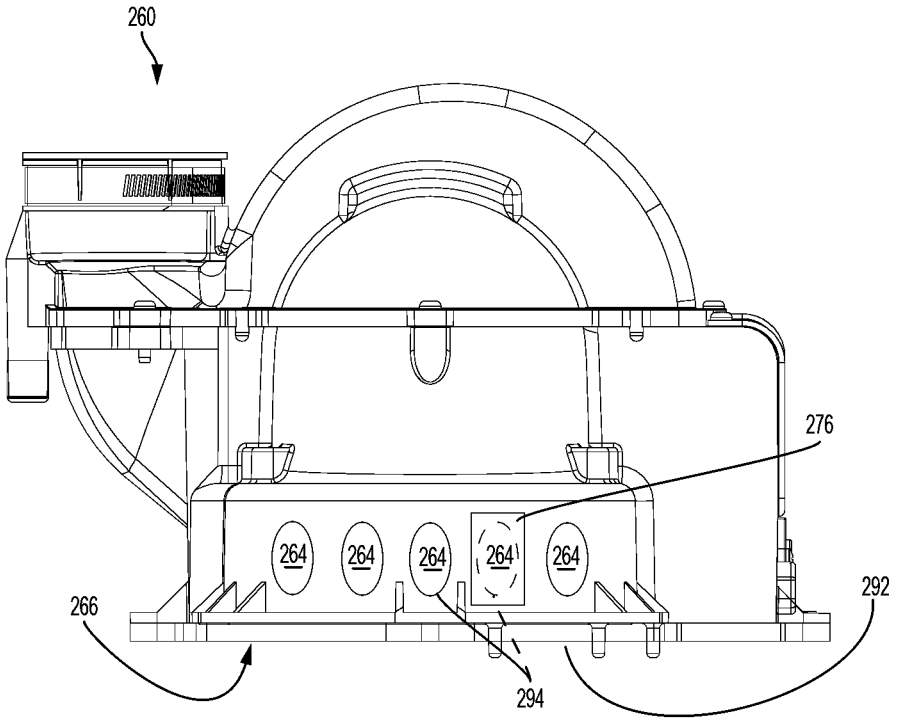
FIG. 11 is a side view of a further embodiment of a blower assembly for use with the gas-fueled heater system shown in FIG. 1.

FIG. 11 depicts an alternative blower assembly 260. The blower assembly 260 is similar to the blower assembly 60, with like part numbers generally indicating similar parts in structure and/or function (e.g., exhaust gas intake passage 266 and exhaust gas passage 66 are the same except where specifically described otherwise). In this embodiment, the exhaust gas intake passage 266 includes a primary opening 292 adapted and configured to receive exhaust gasses from the combustion chamber 52 of the appliance 56. The dilution air intake passage 264 is one or more openings 294 in the combustion gas intake passage 266 positioned such that dilution air mixes with exhaust gasses in the exhaust gas intake passage 266. In this embodiment, the valve 276 is positioned relative to one or more of the opening 294 to restrict the dilution air intake passage 264. The dilution air intake passage 264 is in the low flow configuration when the one or more openings 294 in the combustion gas intake passage 266 are at least partially restricted, and the dilution air intake passage 264 is in the high flow configuration when the one or more openings 294 in the combustion gas intake passage 66 are not restricted.

The valve 276 may be positioned inside or outside of the exhaust gas intake passage 266. In some embodiments, a single valve 276 restricts one opening 294 partially or completely. In alternative embodiments, multiple valves 276 are used.

Figure 12:
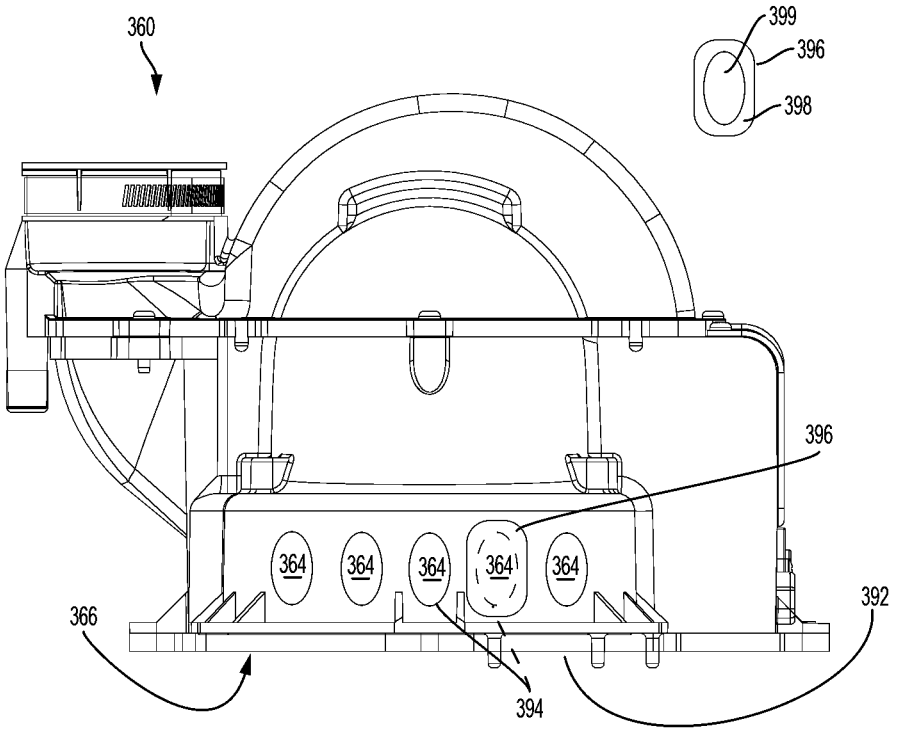
FIG. 12 is a side view of still another embodiment of a blower assembly for use with the gas-fueled heater system shown in FIG. 1.

FIG. 12 depicts an alternative blower assembly 360. Blower assembly 360 is similar to blower assembly 260 but does not include a valve 276. Like part numbers generally indicate similar parts in structure and/or function (e.g., exhaust gas intake passage 366 and exhaust gas passage 266 are the same). Rather than using a valve 276, the dilution air intake passage 364 is movable between a high flow and a low flow configuration using one or more plugs/baffles 396. These plugs 396 can be inserted into the opening 394 that form the dilution air intake passage 364 to restrict the dilution air intake passage 364. Different numbers of plugs 396 may be used depending on the installation of the gas-fueled heater system 50 (e.g., the type and requirements of appliance 56 and/or the length of the vent 54). For example, and without limitation, a user may determine one or more of the type of appliance 56 and the length of the vent 54 and using this information determine (e.g., in reference to a provided table or the like) the appropriate number of plugs 396 to insert into the openings 394. Each plug 396 includes a body portion 398 a raised portion 399 or other structure extending inward towards the opening 394 which engages with the opening 394 to secure the plug 396 within the opening 394.

In view of the foregoing, it will be seen that several advantages are achieved and attained.

The embodiments were chosen and described in order to best explain the principles of the disclosure and its practical application to thereby enable others skilled in the art to best utilize the disclosure in various embodiments and with various modifications as are suited to the particular use contemplated.

As various modifications could be made in the constructions and methods herein described and illustrated without departing from the scope of the disclosure, it is intended that all matter contained in the foregoing description or shown in the accompanying drawings shall be interpreted as illustrative rather than limiting. Thus, the breadth and scope of the present disclosure should not be limited by any of the above-described exemplary embodiments, but should be defined only in accordance with the following claims appended hereto and their equivalents.

What is claimed is:

1. A draft inducer blower assembly for use with a gas-fueled heater system having a combustion chamber and a vent, the blower assembly comprising:

a blower, the blower having a fan, a dilution air intake passage, an exhaust gas intake passage, and a discharge passage, the dilution air intake passage being configured to be in fluid communication with dilution air, the exhaust gas intake passage being adapted to receive exhaust gasses from the combustion chamber, the discharge passage being configured to be in fluid communication with the vent;

the blower being configured to operatively connect to the heater system in a manner such that the blower is configured to facilitate flow of combustion air into the combustion chamber and to draw dilution air into the blower and to mix the dilution air with the exhaust gasses and to facilitate flow of the mixed air and exhaust gases through the vent; and the dilution air intake passage being positionable in at least a low flow configuration and a high flow configuration, the dilution air intake passage being more restrictive of intake of dilution air in the low flow configuration than in the high flow configuration;

wherein the dilution air intake passage comprises a valve movable between a low flow position and a high flow position, the dilution air intake passage being in the high flow configuration when the valve is in the high flow position, the dilution air intake passage being in the low flow configuration when the valve is in the low flow position, and the valve being biased toward the low flow position.

2. A blower in accordance with claim 1, wherein the dilution air intake passage has a first effective cross-sectional area in the low flow configuration and has a second effective cross-sectional area in the high flow configuration, the second effective cross-sectional area being larger than the first effective cross-sectional area.

3. A blower in accordance with claim 1, wherein the blower further comprises a mixing chamber, the blower being configured to draw dilution air and exhaust gases into the mixing chamber at a first ratio of dilution air to exhaust gases when the dilution air intake passage is in the high flow configuration and at a second ratio of dilution air to exhaust gases when the dilution air intake passage is in the low flow configuration, the first ratio being greater than the second ratio.

4. A blower in accordance with claim 1, the valve being adapted to move from the low flow position toward the high flow position as vacuum in the blower downstream of the valve increases beyond a predetermined threshold, the valve being variably positionable between the low flow position and the high flow position as a function of the vacuum.

5. A blower in accordance with claim 4, wherein the valve is biased toward the low flow position by a force resulting from gravity.

6. A blower in accordance with claim 4, wherein the valve is biased toward the low flow position via a spring.

7. A blower in accordance with claim 4, wherein the valve is actuated by the vacuum.

8. A blower in accordance with claim 4, wherein the valve is not actuated by an actuator.

9. A blower in accordance with claim 4, wherein the valve is driven by one or more of a servomechanism, stepper motor, solenoid, or linear actuator.

10. A draft inducer blower assembly for use with a gas-fueled heater system having a combustion chamber and a vent, the blower assembly comprising:

a blower, the blower having a fan, a dilution air intake passage, an exhaust gas intake passage, and a discharge passage, the dilution air intake passage being configured to be in fluid communication with dilution air, the exhaust gas intake passage being adapted to receive exhaust gasses from the combustion chamber, the discharge passage being configured to be in fluid communication with the vent;

the blower being configured to operatively connect to the heater system in a manner such that the blower is configured to facilitate flow of combustion air into the combustion chamber and to draw dilution air into the blower and to mix the dilution air with the exhaust gasses and to facilitate flow of the mixed air and exhaust gases through the vent; and the dilution air intake passage being positionable in at least a low flow configuration and a high flow configuration, the dilution air intake passage being more restrictive of intake of dilution air in the low flow configuration than in the high flow configuration;

wherein the dilution air intake passage comprises a valve movable between a low flow position and a high flow position, the dilution air intake passage being in the high flow configuration when the valve is in the high flow position, the dilution air intake passage being in the low flow configuration when the valve is in the low flow position; and wherein the valve comprises a flap, the flap being resiliently flexible from the low flow position to the high flow position, the resiliency of the flap biasing the flap in the low flow position, the flap being adapted to move from the low flow position toward the high flow position as vacuum in the blower downstream of the valve increases beyond a predetermined threshold, the valve being variably positionable between the low flow position and the high flow position as a function of the vacuum.

11. A draft inducer blower assembly for use with a gas-fueled heater system having a combustion chamber and a vent, the blower assembly comprising:

a blower, the blower having a fan, a dilution air intake passage, an exhaust gas intake passage, and a discharge passage, the dilution air intake passage being configured to be in fluid communication with dilution air, the exhaust gas intake passage being adapted to receive exhaust gasses from the combustion chamber, the discharge passage being configured to be in fluid communication with the vent;

the blower being configured to operatively connect to the heater system in a manner such that the blower is configured to facilitate flow of combustion air into the combustion chamber and to draw dilution air into the blower and to mix the dilution air with the exhaust gasses and to facilitate flow of the mixed air and exhaust gases through the vent; and the dilution air intake passage being positionable in at least a low flow configuration and a high flow configuration, the dilution air intake passage being more restrictive of intake of dilution air in the low flow configuration than in the high flow configuration;

wherein the dilution air intake passage comprises a valve movable between a low flow position and a high flow position, the dilution air intake passage being in the high flow configuration when the valve is in the high flow position, the dilution air intake passage being in the low flow configuration when the valve is in the low flow position; and wherein the valve further comprises a receptacle configured to releasably receive at least a first mass and a second mass, the first mass being of a first weight and the second mass being of a second weight different from the first weight, the first weight and the second weight corresponding to different gas-fueled heater systems having different desirable dilution air flowrates, wherein the first and second masses enable a user to tune the blower to different gas-fueled heater systems.

12. A blower in accordance with claim 1, wherein the valve comprises a damper pivotally movable between the low flow position and the high flow position.

13. A blower in accordance with claim 1, wherein the valve is configured such that when the valve is in the low flow position the dilution air intake passage is restricted but not closed.

14. A blower in accordance with claim 1 further comprising a motor coupled to the fan and adapted and configured to drive the fan, the motor being positioned within the dilution air intake passage such that the motor is cooled by the dilution air before the dilution air mixes with the combustion gases.

15. A blower in accordance with claim 1 further comprising a single speed motor coupled to the fan and adapted and configured to drive the fan, the single speed motor adapted and configured to operate in a single rotational speed range, the motor not operable at any rotational speeds outside the single rotational speed range except during transitory periods in which the motor transitions between on and off states.

16. A blower in accordance with claim 1, wherein the exhaust gas intake passage includes a primary opening adapted and configured to receive exhaust gasses from the combustion chamber, the dilution air intake passage comprising one or more openings in the combustion gas intake passage positioned such that dilution air mixes with exhaust gasses in the exhaust gas intake passage.

17. A blower in accordance with claim 16, wherein the dilution air intake passage is in the low flow configuration when the one or more openings in the combustion gas intake passage are at least partially restricted, and wherein the dilution air intake passage is in the high flow configuration when the one or more openings in the combustion gas intake passage are not restricted.

18. A blower in accordance with claim 17, the valve further comprising at least one valve movable between the low flow position and the high flow position, the dilution air intake passage being in the high flow configuration when the at least one valve is in the high flow position, the dilution air intake passage being in the low flow configuration when the at least one valve is in the low flow position, the at least one valve being capable of at least partially sealing the one or more openings in the combustion gas intake passage.

19. A blower in accordance with claim 17, wherein the dilution air intake passage is in the high flow configuration when the one or more openings in the combustion gas intake passage are not restricted, and wherein the dilution air intake passage is in the low flow configuration when the one or more openings in the combustion gas intake passage are at least partially restricted by more or more plugs adapted and configured to engage with the combustion gas intake passage and at least partially block the one or more openings in the combustion gas intake passage.

20. A blower in accordance with claim 1, wherein the dilution air intake passage includes a baffle adapted and configured to define a minimum opening in the dilution air intake passage.

21. A draft inducer blower assembly for use with a gas-fueled heater system having a combustion chamber and a vent, the blower assembly comprising:

a blower, the blower having a fan, a dilution air intake passage, an exhaust gas intake passage, and a discharge passage, the dilution air intake passage being configured to be in fluid communication with dilution air, the exhaust gas intake passage being adapted to receive exhaust gasses from the combustion chamber, the discharge passage being configured to be in fluid communication with the vent;

the blower being configured to operatively connect to the heater system in a manner such that the blower is configured to facilitate flow of combustion air into the combustion chamber and to draw dilution air into the blower and to mix the dilution air with the exhaust gasses and to facilitate flow of the mixed air and exhaust gases through the vent; and the dilution air intake passage being positionable in at least a low flow configuration and a high flow configuration, the dilution air intake passage being more restrictive of intake of dilution air in the low flow configuration than in the high flow configuration;

wherein the blower is compatible with vents of a predetermined minimum length, vents of a predetermined maximum length, and vents having a length between the minimum and maximum length, wherein the dilution air intake passage is configured to provide more dilution air when the blower is used with the vent of the predetermined minimum length than when the blower is used with the vent of the predetermined maximum length.

22. A method comprising:

coupling a draft inducer blower assembly to a gas-fueled heater system, the gas-fueled heater system having a combustion chamber and a vent, the blower assembly comprising a blower, the blower having a fan, a dilution air intake passage, an exhaust gas intake passage, and a discharge passage, the dilution air intake passage being in fluid communication with dilution air, the exhaust gas intake passage being adapted to receive exhaust gasses from the combustion chamber, the discharge passage being in fluid communication with the vent, the blower being operatively connected to the heater system in a manner such that the blower is configured to facilitate flow of combustion air into the combustion chamber and to draw dilution air into the blower and to mix the dilution air with the exhaust gasses and to facilitate flow of the mixed air and exhaust gases through the vent, the dilution air intake passage capable of being in at least a low flow configuration and a high flow configuration, the dilution air intake passage being more restrictive of intake of dilution air in the low flow configuration than in the high flow configuration, wherein the dilution air intake passage comprises a valve movable between a low flow position and a high flow position, the dilution air intake passage being in the high flow configuration when the valve is in the high flow position, the dilution air intake passage being in the low flow configuration when the valve is in the low flow position, and the valve being biased toward the low flow position.

23. A method in accordance with claim 22 further comprising automatically moving the valve such that the dilution air intake passage moves between the low flow configuration and the high flow configuration in relationship to vacuum in the blower downstream of the valve, the air intake passage moving from the low flow configuration toward the high flow configuration as the vacuum increases beyond a predetermined threshold.

24. A method in accordance with claim 22 further comprising causing the dilution air intake passage to be in the low flow configuration.

25. A method in accordance with claim 22 further comprising causing the dilution air intake passage to be in the high flow configuration.

26. A method in accordance with claim 22 further comprising causing the dilution air intake passage to move from the low flow configuration to the high flow configuration.

27. A method in accordance with claim 22 further comprising causing the dilution air intake passage to move from the low flow configuration toward the high flow configuration.

28. A method in accordance with claim 22 further comprising causing the dilution air intake passage to move away from the low flow configuration toward the high flow configuration.

29. A method in accordance with claim 22 further comprising manually configuring the dilution air intake passage such that the dilution air intake passage is in one of the low flow configuration, the high flow configuration, or an intermediate flow configuration, the dilution air intake passage being more restrictive of intake of dilution air in the intermediate flow configuration than in the high flow configuration, the dilution air intake passage being less restrictive of intake of dilution air in the intermediate flow configuration than in the low flow configuration.

30. A method in accordance with claim 29 further comprising adjusting one of the low flow configuration, the high flow configuration, and the intermediate flow configuration based on one or more of a length of the vent, a make of the gas-fueled heater system, a model of the gas-fueled heater system, and a type of the gas-fueled heater system.

* * * * *